United States Patent [19]

Brandt

[11] Patent Number: 4,841,656

[45] Date of Patent: Jun. 27, 1989

[54] SLIDING SAFETY MECHANISM FOR PROJECTILE WEAPONS

[76] Inventor: Raymond W. Brandt, 11220 St. Joe Rd., Fort Wayne, Ind. 46815

[21] Appl. No.: 107,883

[22] Filed: Oct. 9, 1987

Related U.S. Application Data

[63] Continuation of Ser. No. 11,354, Jan. 30, 1987, abandoned, which is a continuation of Ser. No. 784,042, Oct. 4, 1985, abandoned.

[51] Int. Cl.[4] ..... F41C 17/02

[52] U.S. Cl. ..... 42/70.06; 42/70.01

[58] Field of Search ..... 42/70.01, 70.03, 70.04, 42/70.05, 70.06, 70.08

[56] References Cited

U.S. PATENT DOCUMENTS

| | | | |
|---|---|---|---|
| 934,065 | 9/1909 | Gates | 42/70.08 |
| 2,457,929 | 1/1949 | Slockbower | 42/70 R |
| 2,484,928 | 10/1949 | Boone | 42/70 E |
| 2,775,051 | 12/1956 | Gehman | 42/70 E |
| 2,819,550 | 1/1958 | Fischer | 42/70.04 |
| 4,141,166 | 2/1979 | Schultz | 42/70.04 |

*Primary Examiner*—Charles T. Jordan
*Assistant Examiner*—Richard Klein
*Attorney, Agent, or Firm*—Marshall & Melhorn

[57] ABSTRACT

A safety mechanism for a projectile weapon includes a stop means such as a lever pivotally mounted to prevent the movement of the trigger to a position enabling the weapon to be discharged. A biasing means such as a spring is also attached to the lever to maintain the lever in the blocking position. Spaced from the trigger on the stock of the weapon is an actuator mounted for movement on the exterior of stock and pivotally connected to a second lever which is pivotally attached to the stock. The first and second levers are connected by a transfer bar such that movement of the actuator shifts the first lever with respect to the trigger to allow the trigger to be moved to the discharge position. The actuator is shown in the form of a slidable plate and a push button.

5 Claims, 1 Drawing Sheet

SLIDING SAFETY MECHANISM FOR PROJECTILE WEAPONS

FIELD OF THE INVENTION

The present invention relates generally to a safety mechanism for projectile weapons and in particular to a device for preventing the movement of the trigger of a weapon to a position which would result in a discharge of a loaded weapon.

DESCRIPTION OF THE PRIOR ART

Each year many persons are killed by the accidental and unintentional discharge of projectile weapons such as firearms. Thus, there is a need for a device which will prevent the movement of a trigger and/or hammer to a position in which the weapon can be discharged. However, such a device must be easy to install and use in order to encourage the use of such a safety mechanism with all weapons. In the case of a rifle, it would be advantageous to be able to unlock the safety mechanism after the rifle has been aimed at a target.

Many types of safety devices for firearms are known. One group of such devices involves a pin or slide which is moved into and out of engagement with the hammer such as shown in U.S. Pats. Nos. 289,875; 311,323; 792,381; and 1,227,531. Another type of safety mechanism involves a pin or lever which prevents the actuation of the trigger mechanism such as shown in U.S. Pats. Nos. 80,043; 132,222; 206,217; 239,652; 2,379,946; 2,458,616; 2,657,490; 3,153,874; 3,222,809; 3,711,979; 3,713,239; 3,713,242; 3,732,641; 3,861,069; 3,964,200; and 4,050,662. In the alternative, there is a class of devices which blocks the insertion of a finger in front of the trigger to prevent the actuation of the trigger such as shown in U.S. Pats. Nos. 1,079,855; 1,563,250; 1,569,553; 2,195,693; 2,525,886; 2,590,516; 2,664,658; 3,422,560; 3,956,842; 4,084,341; 4,198,026; 4,299,045; and 4,395,837.

All of the above mentioned prior art devices have disadvantages such as being complicated in structure and requiring substantial modifications to the firearms. With respect to those devices which utilize removable pins, the pins are easily lost rendering the safety mechanism inoperable.

Finally, there is a class of devices which attempts to permit release of the safety mechanism after a rifle has been aimed as shown in U.S. Pats. Nos. 313,170; 317,545; 2,525,886; 3,222,809; and 3,978,604.

SUMMARY OF THE INVENTION

The present invention is concerned with a safety mechanism for a projectile weapon which remains in the safe or off position until the weapon has been aimed and is ready to fire. An actuator such as a slidable release plate is built into a side portion of the weapon stock at a position where the left hand of a right-handed shooter would grip the stock. As the weapon is aimed, the left hand fingers tense in a rearward motion to shift the sliding plate rearwardly to disengage the safety mechanism. The sliding plate is connected to a transfer bar which in turn is connected to a pin or lever which is normally biased to block actuation of the trigger. The shifting of the sliding plate in the rearward direction moves the pin or lever out of the way of the trigger which is then free for movement which will fire the weapon. In an alternate embodiment, a button mounted on the stock is pushed in to actuate the transfer bar.

It is an object of the present invention to provide a safety mechanism for a projectile weapon which can be easily operated after the weapon has been brought into a firing position.

It is a further object of the present invention to provide a safety mechanism for a projectile weapon which is economical to manufacture and install on weapons.

It is a further object of the invention to provide a safety mechanism for weapons which is child resistant.

DETAILED DESCRIPTION OF THE DRAWINGS

DESCRIPTION OF THE PREFERRED EMBODIMENT

Figure 1:
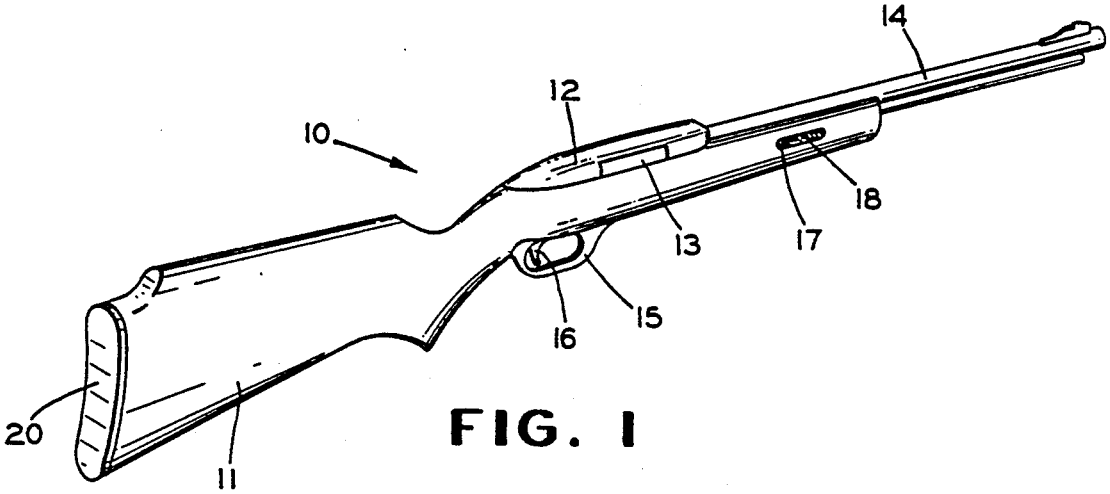
FIG. 1 is a perspective view of a rifle showing the external actuating slide for a safety mechanism according to the present invention for preventing the actuation of the trigger of the rifle.
Figure 2:
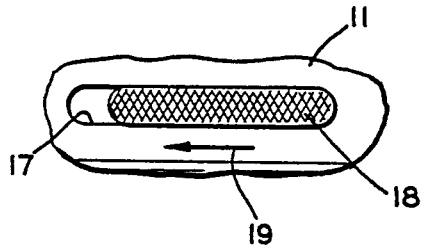
FIG. 2 is an enlarged fragmentary view of the portion of the stock of the rifle of FIG. 1 in which the sliding plate is located.

There is shown in FIG. 1 a perspective view of a rifle incorporating a safety mechanism according to the present invention. The rifle 10 includes a stock 11, a receiver 12 mounted on the top of the stock 11 including an ejection port 13 for ejecting spent shells from the rifle, a barrel 14, a trigger guard 15, and a trigger 16. As seen more clearly in FIG. 2, an actuator for a safety mechanism is normally positioned in a slot 17 formed in the stock 11. Although a rifle has been shown, the present invention can be utilized with a wide variety of projectile weapons such as crossbows, shotguns and air rifles. The actuator can be a plate 18 shown in its most forward position and the plate 18 is free to move in the slot 17 in a rearward direction as shown by the arrow 19. Typically, the sliding movement of the actuator 18 is approximately 3/16 of an inch.

When the rifle 10 is held by a right-handed shooter, the rear end 20 of the stock 11 is placed against the right shoulder, the right hand is placed about the stock in the vicinity of the trigger guard 15 and the index finger of the shooter is inserted in the trigger guard in front of the trigger 16. The left hand is wrapped about the front end of the stock 11 in the area of the slot 17 such that the tips of the fingers on the left hand fall on the sliding actuator 18. As the shooter sights down the top of the barrel 14, he moves the gun into firing position and the fingers of the left hand contact the sliding safety plate 18 shifting it in the direction of the arrow 19 thereby releasing the safety which normally blocks actuation of the trigger 16.

Figure 3:
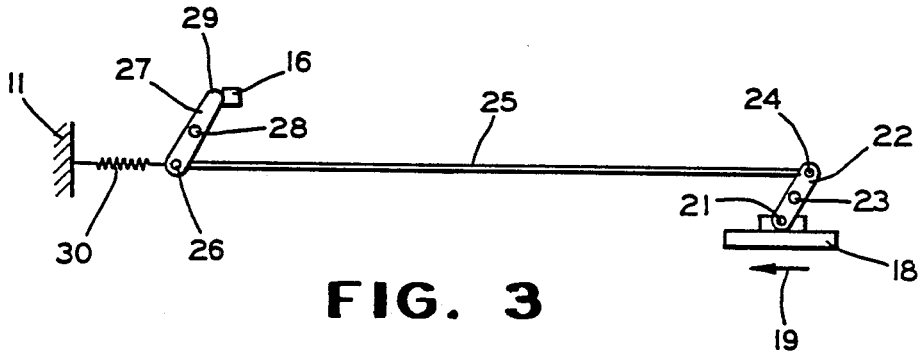
FIG. 3 is a schematic view of the safety mechanism incorporated in the rifle shown in FIG. 1.

As more clearly seen in the schematic diagram of FIG. 3, the actuator 18 is pivotally connected at a pivot point 21 to one end of a lever arm 22. The lever arm 22 pivots about a central pivot point 23 and has its other end pivotally connected at a pivot point 24 to one end of a transfer bar 25. The transfer bar 25 extends from the area of the slot 17 to the area of the trigger 16 and has its other end pivotally connected at a point 26 to one end of a lever arm 27. The lever arm 27 is pivotally attached in the receiver 12 at a central pivot point 28 and has its other end 29 in contact with a portion of the trigger 16 to act as a stop means so as to prevent actuation of the trigger 16. The end of the lever arm 27 which is pivotally connected to the transfer bar 25 is also connected to one end of a spring 30 which has its other end anchored in the receiver 12 area. The spring 30 is in tension and biases the safety mechanism in the safe position such that the end 29 of the lever arm 27 is abutting the trigger 16 and the sliding safety plate 18 is in its forward most position. The rearward movement of the fingers which are in contact with the siding safety plate 18 must apply sufficient pressure to overcome the biasing force of the spring 30. The spacing of the actuator 18 from the trigger 16, and the requirement that the actuator be maintained in its rearward position by pressure applied by the human hand against the spring 30 is a deterrent to accidental disengagement of the safety mechanism and actuation of the trigger by a child.

Figure 4:
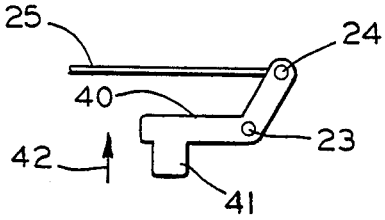
FIG. 4 is a schematic view of an alternate embodiment of the safety mechanism shown in FIG. 3.

There is shown in FIG. 4 an alternate embodiment of the safety mechanism shown in FIG. 3. The transfer bar 25 is pivotally connected at the pivot point 24 to a lever 40. The lever 40 pivots about the central pivot point 23. The lever 40 is generally L-shaped and includes a button portion 41 formed at the end opposite the pivot point 24. The button extends through the wall of the stock (not shown) and pressure from a finger of the left hand shifts the lever 40 in the direction of the arrow 42 to disengage the safety.

In accordance with the provisions of the patent statues, the principle and mode of operation of the invention have been explained in its preferred embodiment. However, it must be understood that the invention may be practiced otherwise then specifically illustrated and described without departing from its spirit or scope.

What is claimed is:

1. A safety mechanism for a projectile weapon, the weapon including a stock and a trigger mounted on the stock and capable of being moved between a non-discharge position and a discharge position, comprising:

stop means including a lever arm pivotally movable between a first position blocking movement of a trigger of a projectile weapon from a non-discharge position to a discharge position and a second position permitting movement of the trigger between the non-discharge position and the discharge position, one end of said lever arm engaging the trigger in said first position and being spaced from the trigger in said second position;

means for biasing said lever arm to said first position;

a transfer bar having one end attached to an opposite end of said lever arm and an opposite end;

a lever adapted to be pivotally attached to the weapon and having one end attached to said opposite end of said transfer bar and an opposite end; and an actuator adapted to be mounted for movement on a stock of the weapon and attached to said opposite end of said lever, and spaced from the trigger a distance requiring two hands to discharge the weapon whereby when a person moves the weapon into position for firing, at least a portion of one hand engages the trigger and at least a portion of another hand engages said actuator and tenses as the stock is pulled into the person's shoulder to move said actuator thereby causing said lever and said transfer bar to move said stop means from said first position to said second position and allow the portion of said one hand to move the trigger to the discharge position.

2. The safety mechanism according to claim 1 wherein said actuator moves approximately three sixteenths of an inch to move said stop means between said first and second positions.

3. The safety mechanism according to claim 1 wherein said means for biasing includes a tension spring having one end attached to an opposite end of said lever arm and having an opposite end attached to the weapon.

4. The safety mechanism according to claim 1 wherein said actuator is a plate slidably mounted on the stock and attached to said opposite end of said lever.

5. The safety mechanism according to claim 1 wherein said actuator is a button mounted on the stock and attached to said opposite end of said lever.

* * * * *